US008991556B2

(12) United States Patent
Auston et al.

(10) Patent No.: US 8,991,556 B2
(45) Date of Patent: Mar. 31, 2015

(54) FALL ARREST BLOCK

(75) Inventors: Oliver Auston, Faversham (GB); Duncan Barrier, Faversham (GB)

(73) Assignee: Checkmate Limited, Sheerness (GB)

( * ) Notice: Subject to any disclaimer, the term of this patent is extended or adjusted under 35 U.S.C. 154(b) by 674 days.

(21) Appl. No.: 12/673,475

(22) PCT Filed: Aug. 11, 2008

(86) PCT No.: PCT/GB2008/002748

§ 371 (c)(1),
(2), (4) Date: Mar. 10, 2010

(87) PCT Pub. No.: WO2009/022137

PCT Pub. Date: Feb. 19, 2009

(65) Prior Publication Data

US 2011/0209948 A1 Sep. 1, 2011

(30) Foreign Application Priority Data

Aug. 13, 2007 (GB) ..... 0715786.0

(51) Int. Cl.
*A62B 35/00* (2006.01)
*B65H 75/22* (2006.01)
*B65H 75/28* (2006.01)

(52) U.S. Cl.
CPC ..... *A62B 35/0093* (2013.01); *B65H 75/22* (2013.01); *B65H 75/28* (2013.01); *B65H 2701/5136* (2013.01)
USPC ..... 182/239; 182/70; 182/234; 188/180

(58) Field of Classification Search
USPC ..... 182/231–239, 70, 71, 73; 188/180
See application file for complete search history.

(56) References Cited

U.S. PATENT DOCUMENTS

| | | | | | |
|---|---|---|---|---|---|
| 939,375 | A | * | 11/1909 | Andrews | 182/232 |
| 4,010,913 | A | | 3/1977 | Guerster et al. | |
| 4,489,919 | A | * | 12/1984 | Ostrobrod | 254/346 |
| 4,512,361 | A | | 4/1985 | Tisbo et al. | |
| 4,846,313 | A | | 7/1989 | Sharp | |
| 4,877,110 | A | * | 10/1989 | Wolner | 182/232 |
| 5,186,289 | A | * | 2/1993 | Wolner et al. | 188/180 |
| 5,343,976 | A | | 9/1994 | Ostrobrod | |
| 6,279,682 | B1 | | 8/2001 | Feathers | |
| 6,371,244 | B2 | * | 4/2002 | Okamura | 182/72 |

(Continued)

FOREIGN PATENT DOCUMENTS

| | | |
|---|---|---|
| AU | 412907 | 1/1969 |
| DE | 2 500 685 | 7/1976 |

(Continued)

OTHER PUBLICATIONS

Extended European Search Report from a corresponding European patent application bearing a mailing date of Jul. 25, 2012, 6 pages.

*Primary Examiner* — Alvin Chin-Shue
*Assistant Examiner* — Colleen M Chavchavadze
(74) *Attorney, Agent, or Firm* — Burr & Brown, PLLC

(57) ABSTRACT

A fall arrest block has a drum (40) on which a lifeline is wound and from which the line can be drawn off or drawn back on, as the work man moves towards and away from the block. One end of the lifeline is permanently secured to the drum, and the drum has sockets (50) for securing ends of more than one different type of lifeline. The block also has a brake (24) in the form of a sealed unit which can be removed and replaced with a fresh unit, when servicing of the brake is required.

19 Claims, 10 Drawing Sheets

(56) References Cited

U.S. PATENT DOCUMENTS

| | | | | |
|---|---|---|---|---|
| 7,481,399 | B2 * | 1/2009 | Nohren et al. | 244/122 R |
| 7,946,387 | B2 * | 5/2011 | Betcher et al. | 182/231 |
| 8,181,744 | B2 * | 5/2012 | Parker et al. | 182/232 |
| 2005/0051659 | A1 | 3/2005 | Wolner et al. | |
| 2005/0092366 | A1 | 5/2005 | Schaller | |
| 2005/0217937 | A1 * | 10/2005 | Rohlf | 182/232 |
| 2006/0021825 | A1 | 2/2006 | An et al. | |
| 2006/0054730 | A1 * | 3/2006 | Paterson et al. | 242/382 |
| 2009/0260922 | A1 * | 10/2009 | Marquardt et al. | 182/232 |
| 2010/0065373 | A1 * | 3/2010 | Stone et al. | 182/233 |

FOREIGN PATENT DOCUMENTS

| | | |
|---|---|---|
| EP | 0 247 818 | 12/1987 |
| FR | 2 754 719 | 4/1998 |
| GB | 2 143 495 | 2/1985 |
| GB | 2 306 107 | 4/1997 |
| GB | 2 432 141 | 5/2007 |
| JP | 8-215326 | 8/1996 |
| JP | 2004-249062 | 9/2004 |
| WO | 95/19203 | 7/1995 |
| WO | 01/75909 | 10/2001 |

* cited by examiner

FALL ARREST BLOCK

This invention relates to a fall arrest block for use by a workman working above the ground. The block will be connected to a secure fixed point, and a lifeline wound on the block is connected to a harness worn by the workman, with the lifeline winding up and unwinding under spring control whilst the workman moves around, but locking up and providing a soft landing if the workman falls.

In this specification, the term "lifeline" or "lifeline medium" is used to denote the connecting line between the block and the workman, and which is wound onto a drum within the fall arrest block.

Some fall arrest blocks use wire rope as the lifeline, others use webbing and still others use a fibre rope. The choice of lifeline is individual to the user and the environment. For example, wire lifelines are not used in areas where the production of a spark is to be avoided but are preferred over webbing lines where there is a risk of chafe. The lifelines are wound on a drum in the block, and conventional blocks use a different design of drum, depending on the nature of the lifeline.

According to the present invention, there is provided a drum for use in a fall arrest block, the drum comprising a core and flanges on either side of the core, wherein the core and one of the flanges are formed as a plastics moulding, and the core has separate anchorage points for more than one type of lifeline.

The drum preferably has anchorage points for wire rope and for webbing.

The drum can be a skeletal plastics moulding, and the outer periphery of the drum can be discontinuous, with the circumference on which the lifeline is wound being formed by annularly spaced regions around a pitch circle. The core and said one of the flanges are preferably formed as a single plastics moulding.

The other of the flanges can be in the form of a disc, and the core and the other flange may have interengaging formations which prevent relative rotation between the flange and the core.

A spring is preferably provided to rewind the lifeline onto the drum, the core and said one of the flanges being famed as a single plastics moulding and the moulding incorporating a housing for the spring on the side of said one of the flanges which faces away from the core.

The invention also provides a brake unit for use in a fall arrest block, the unit comprising a first part which is adapted to be secured to a chassis of the block, a second part which can be locked to the drum when a fall is to be arrested, and friction surfaces within the unit which allow rotation between the first and second parts against the friction generated by the friction surfaces, characterised in that the brake unit is a sealed unit.

The brake unit is preferably in the form of a disc, with the first part forming the centre of the disc and the second part in the form of an annulus lying generally around the edge of the first part. The first part can be in the form of two spaced plates connected by axially extending studs by which the first part can be secured to the chassis. The second part can be a ring, with an inwardly directed annular flange which lies between the two spaced plates and with an outwardly directed periphery carrying teeth which can be engaged by a pawl to lock the second part to a drum on which a lifeline is wound.

Friction linings can be provided between the plates and the inwardly directed flange, on both sides of the flange. The linings can be in the form of annuli.

O-rings can be provided to seal between the first and second parts. The O-rings can be fitted between the circumferential outer edges of the spaced discs, and opposing flanges on the second part.

The invention also extends to a fall arrest block incorporating a brake unit as set forth above, to a fall arrest block incorporating a drum as set firth above, and to a fall arrest block incorporating both a drum as set forth above and a brake unit as set forth above.

The invention will now be further described, by way of example, with reference to the accompanying drawings, in which.

Figure 4:
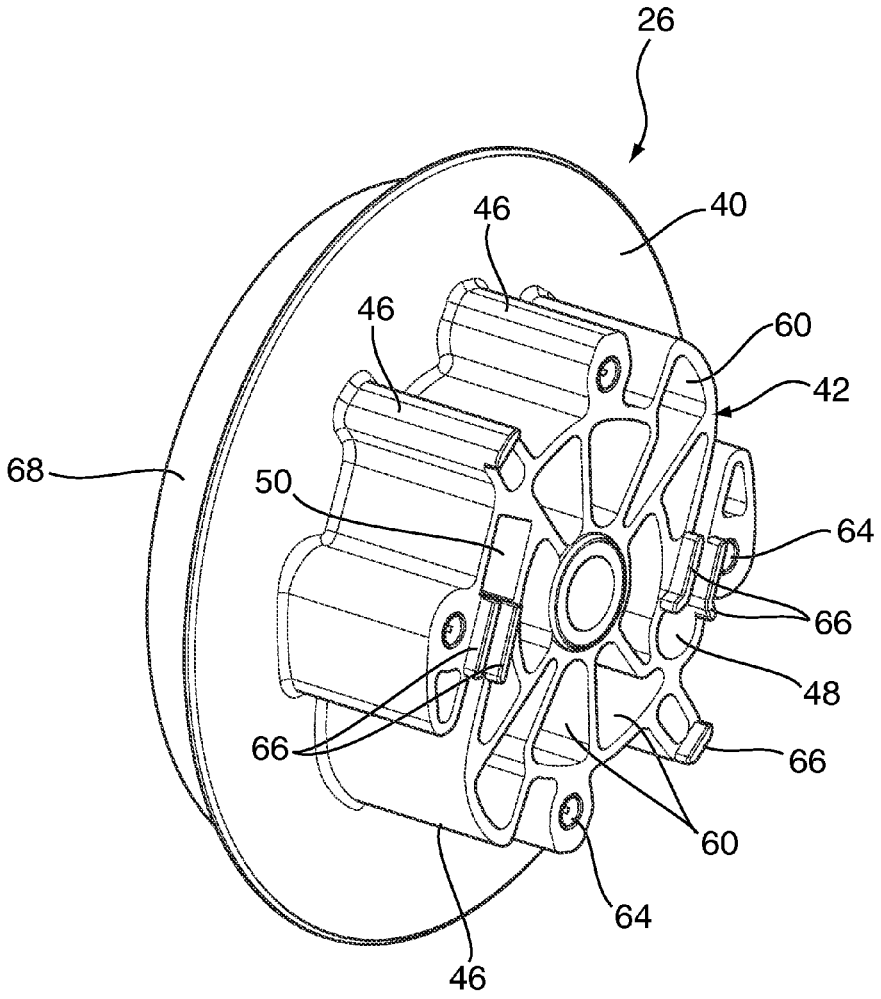
FIG. 4 is a perspective view of the lifeline drum, separated from the other components of the block.
Figure 5:
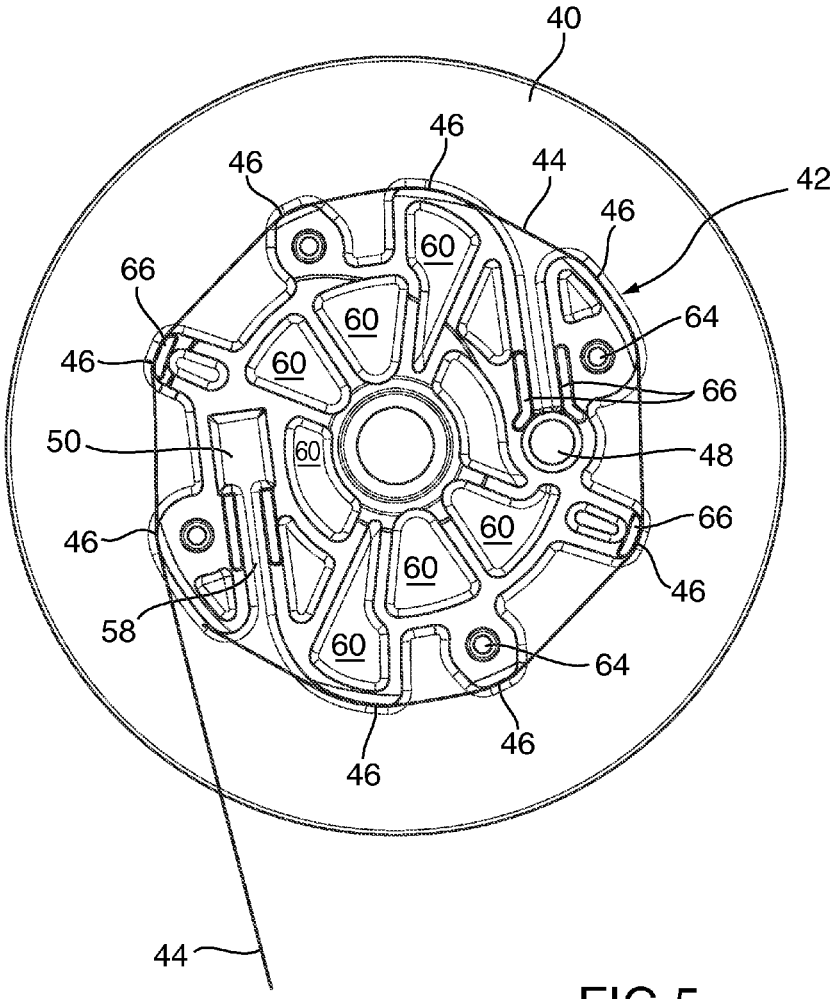
FIG. 5 is a plan view of the drum of FIG. 4.
Figure 5A:
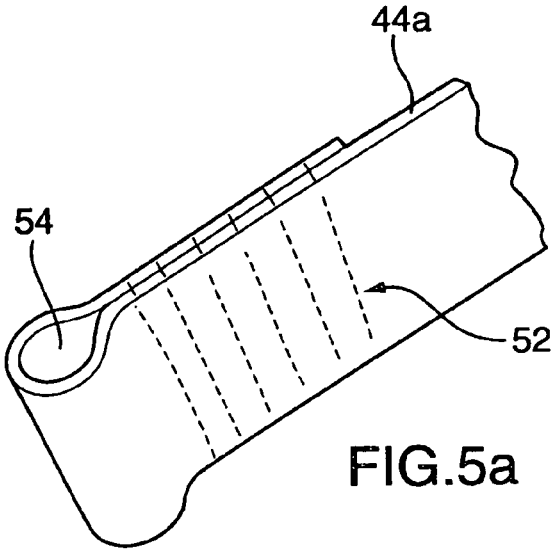
Figure 5B:
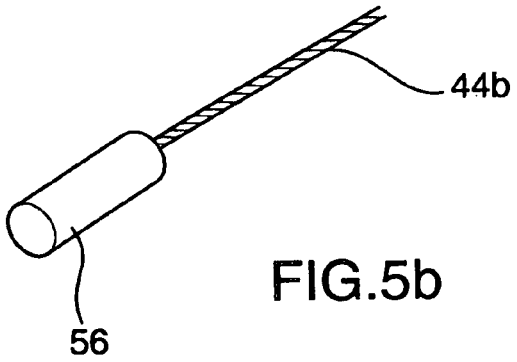
Figure 6:
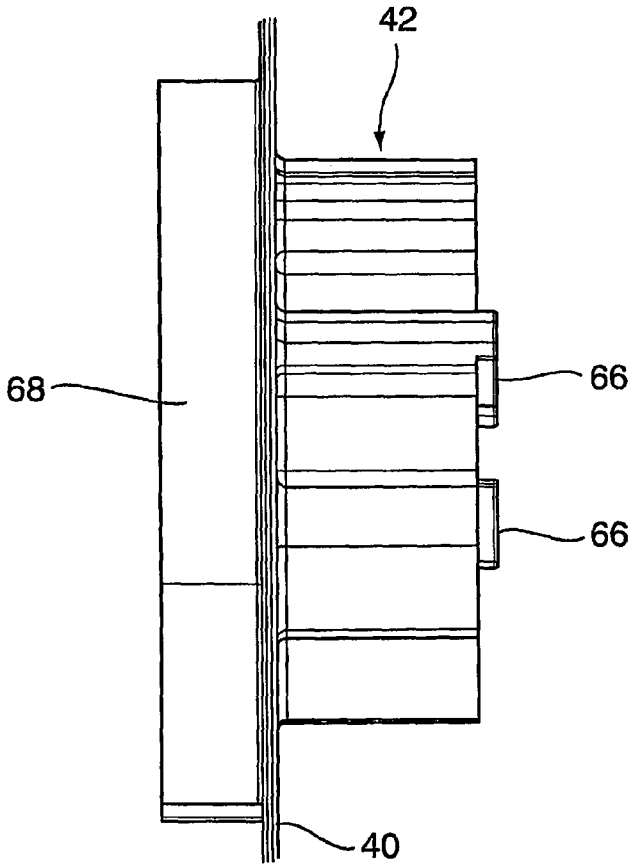
Figure 7:
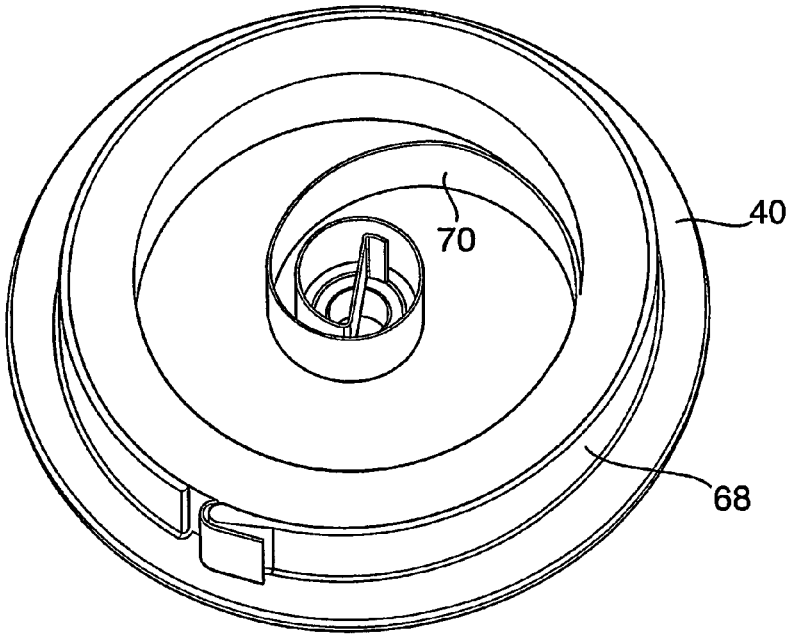
Figure 8:
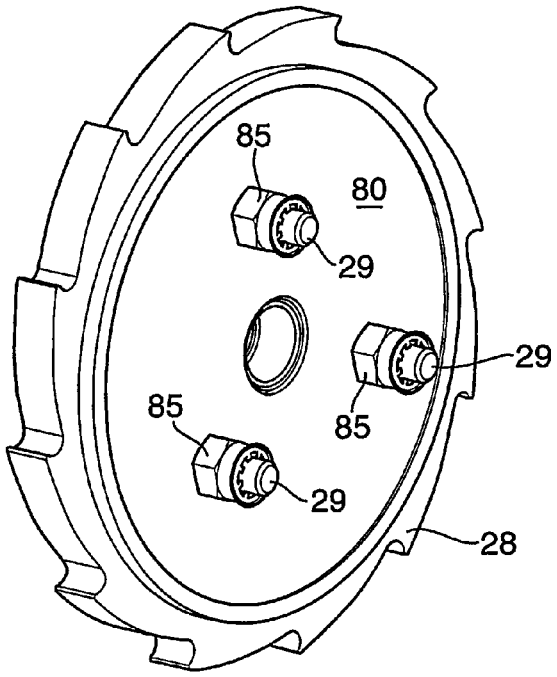

FIGS. 5*a* and 5*b* show how two different lifelines can be terminated for use with the drum of FIGS. 4 and 5;

FIG. 6 is a side view of the drum of FIGS. 4 and 5;

FIG. 7 is a perspective, rear view of the drum;

FIG. 8 shows a brake assembly forming part of the fall arrest block; and

Figure 9:
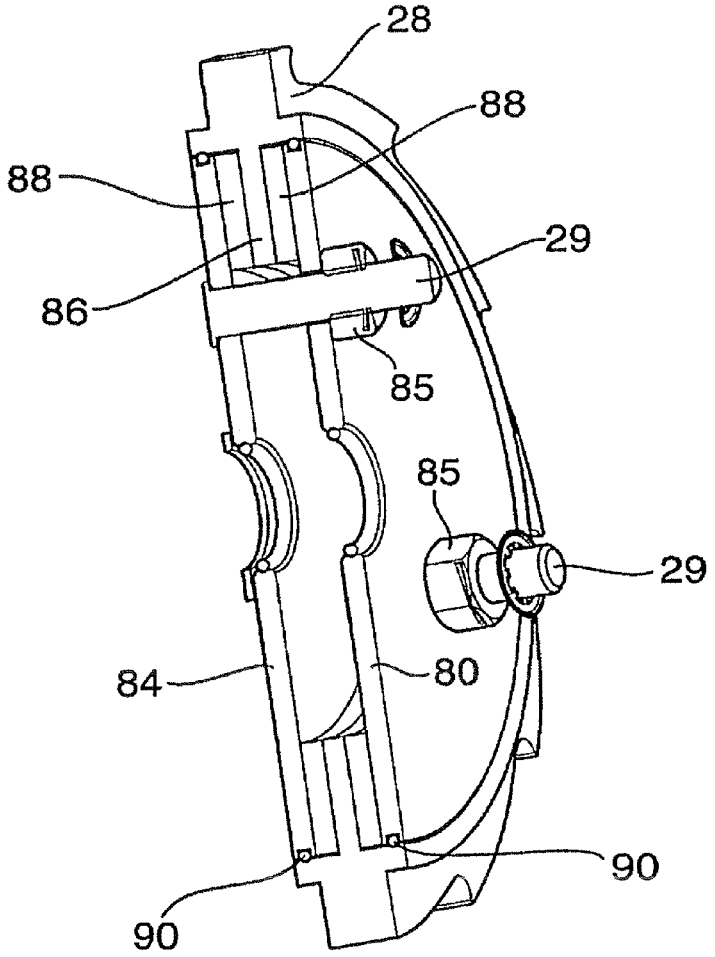

FIG. 9 is a cross-section through the brake assembly of FIG. 8.

Figure 1:
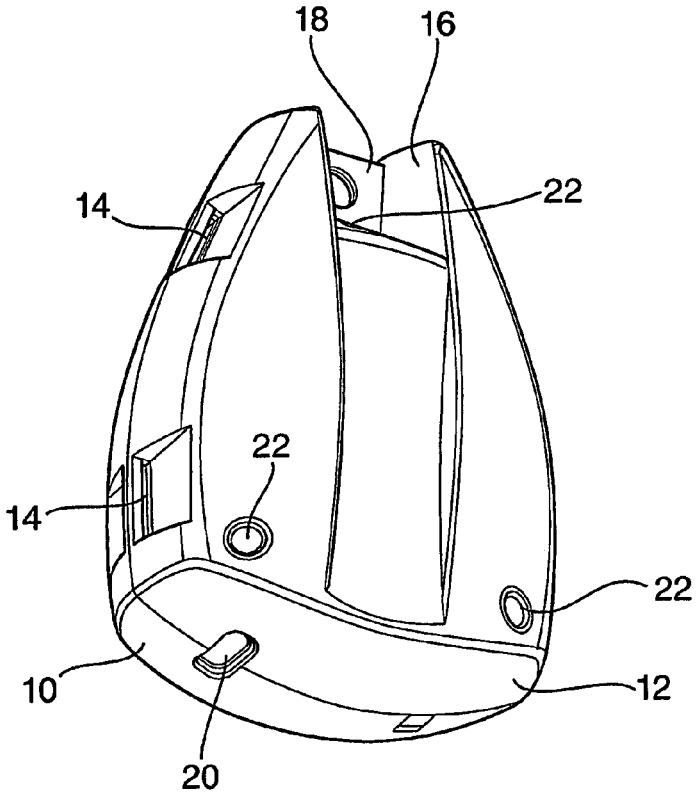
FIG. 1 is an external perspective view of a fall arrest block in accordance with the invention.

FIG. 1 shows the external housing of a fall arrest block which is contained within a housing made up from two plastics moulded cover sections 10, 12. The cover sections have slots 14 through which a carrying handle can be threaded, and a recess 16 through which a metal hanger plate 18 extends. The block will be attached to a fixed structure by means of a link passing through the hole in the plate 18, and the plastics housing halves 10, 12 will carry no load.

In use, a lifeline will extend out of the housing through an opening 20, and the two halves of the housing will be secured together by screws passing through apertures 22.

Figure 2:
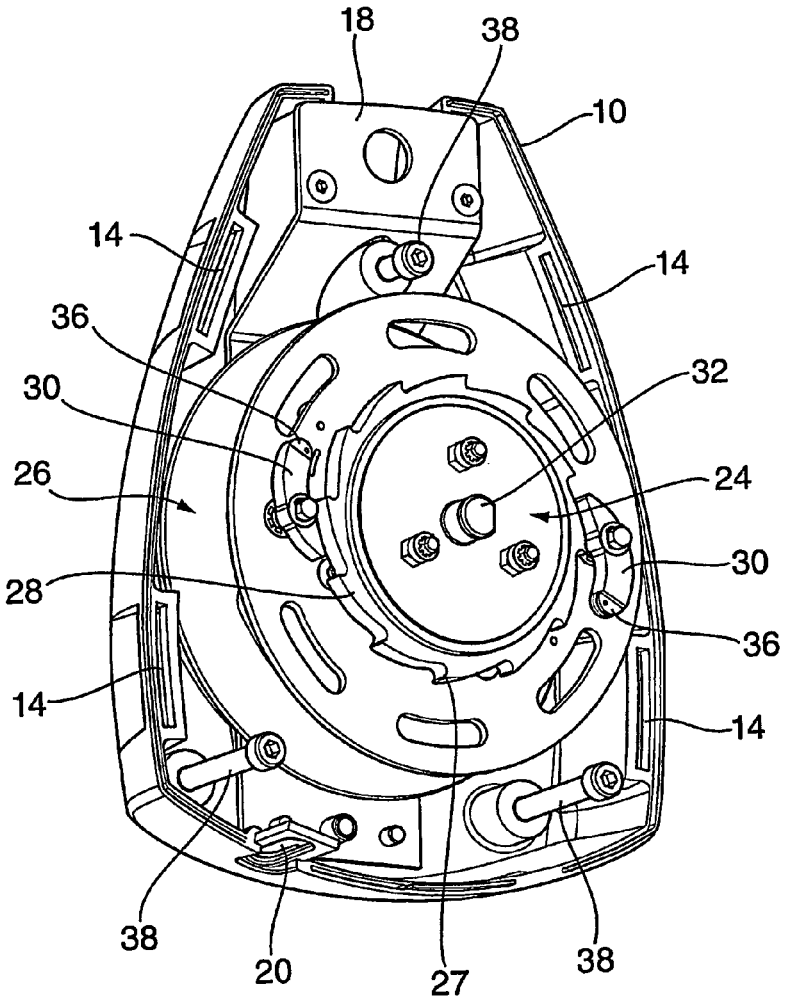
FIG. 2 shows the block of FIG. 1 with one cover removed, to show the internal components.
Figure 3:
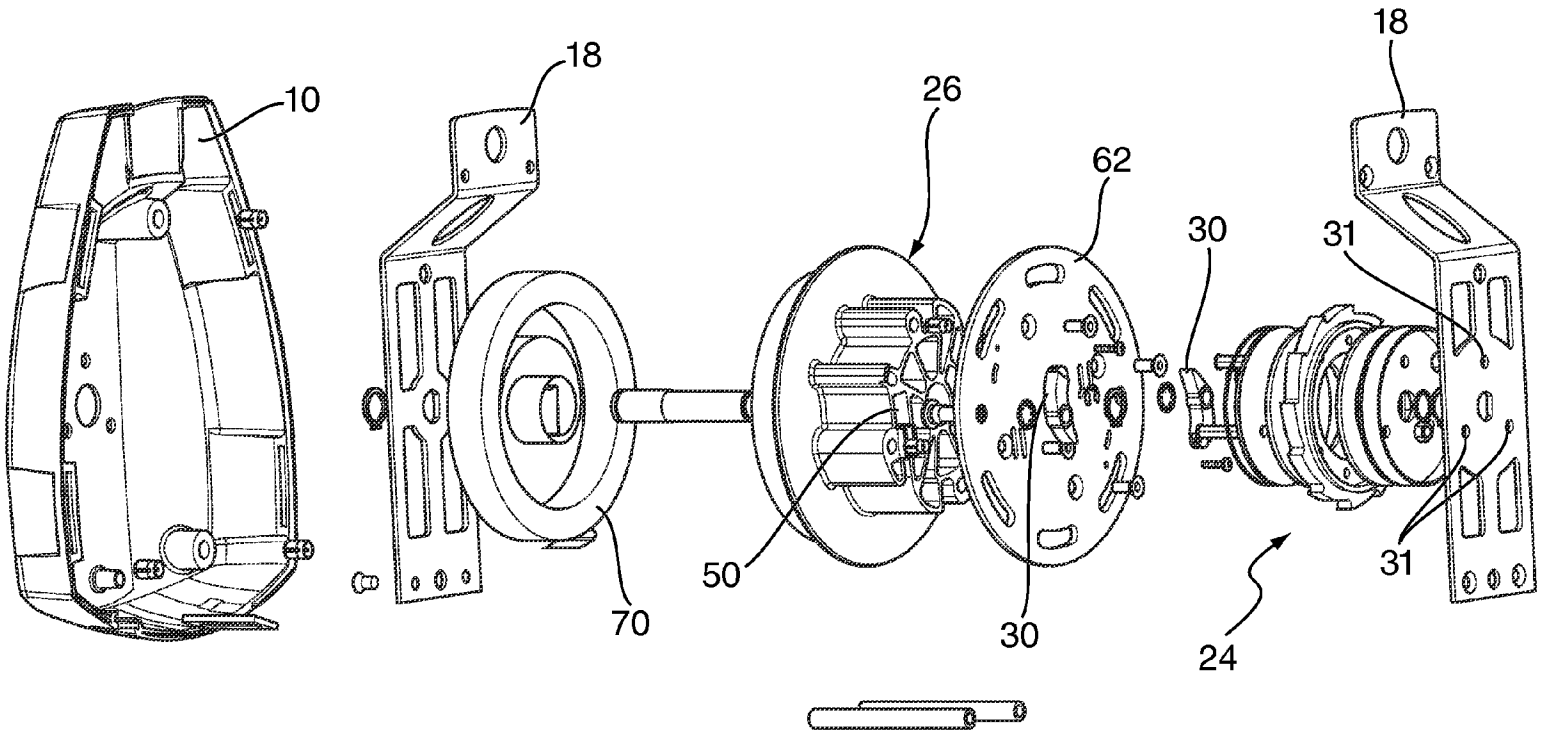
FIG. 3 shows the block in an exploded view.

FIG. 2 shows the internal components of the block, with one of the housing cover sections 12 removed. Within the housing there is a chassis formed by two hanger plates 18. One of those plates has been removed in FIG. 2 so that the other components can be seen. Between the two hanger plates (both plates are visible in FIG. 3) there is a brake unit generally designated 24 and a lifeline drum generally designated 26. It will be seen from FIG. 2 that the brake unit 24 has en outer ring 28 with a series of teeth and that two pawls 30 are mounted on the drum 26. Under normal operation the brake unit will be held stationary as the unit is secured to the right hand hanger plate 18 by three threaded studs 29 passing through holes 31 in the plate, and the pawls 30 will remain outside the pitch circle of the teeth 28. The drum 26 on which the pawls 30 are mounted can then rotate freely, against the action of a spring behind the drum. Thus the lifeline (which is not shown in the figures) can be pulled off from the block resulting in rotation of the drum 26, and can be rewound onto the block through the action of the spring (which will be described later). However if there should be a sudden rapid pull on the lifeline if a workman falls, the drum 26 will rotate fast and this will cause the pawls 30 to pivot about their axes and to engage with the teeth 28. The pawls 30 are provided with weighted ends 36 so that centrifugal force will cause the weighted end to fly outwards and the opposite end of the pawl to engage with the teeth. At this point the drum 26 is locked to the outer rim of the brake unit. The brake unit can however still rotate, but this time against the braking force generated by the brake unit 24 which will absorb energy and thus allow the workman's fall to be arrested.

FIG. 2 also shows the screws 38 which secure the two halves of the cover together.

Turning now to FIGS. 4 and 5, the main part of the drum 26 is a plastics moulding with a flange 40 and a core generally designated 42. The core 42 is not a solid body, but is skeletal in nature. A lifeline indicated schematically at 44 (FIG. 5) will be wound around the drum. In FIG. 5 only one turn of lifeline is shown, but it will be understood that in fact there will be multiple turns of lifeline around the drum. The lifeline stretches between contact points indicated at 46. Within the skeletal core are two lifeline anchorage points 48 and 50. The anchorage point 48 is for use with a fibre rope or webbing lifeline. To anchor a webbing lifeline, the and of the webbing 44*a* would be doubled back on itself as shown in FIG. 5*a* and stitched at 52 to leave an eye 54 at the end. This end of the webbing will then be inserted into the recess 48, and a metal pin placed inside the eye 54. The diameter of the metal pin and of the eye 54, together with the thickness of the webbing will be sufficient to lock the webbing in the recess 48.

A similar technique can be used if the lifeline is of braided fibre rope, when an eye splice can be formed in the end of the rope and a pin inserted in the same way as just described.

If the lifeline instead is a wire cable 44*b*, then this will be secured in the drum at 50, and to secure the cable the end of the cable will be provided with a swaged on terminal 56 (FIG. 5*b*) which will fit within the rectangular recess at 50, with the cable 44*b* suiting the anchorage point 50 through the passage 58.

The other openings in the skeletal core (some of which indicated at 60) are designed to reduce the overall weight of the core, whilst ensuring that the core remains rotationally balanced.

The drum 26 is completed by a second flange 62 (FIG. 3) which is secured to the core 42 through screws through the plate 62 into threaded inserts 64 in the drum 40. The core 42 has upstanding lips 66 (see FIG. 6) which engage in corresponding recesses in the plate 62.

On the back of the flange 40 an integrally moulded cup 68 houses a clock spring 70. This spring 70 will wind the lifeline back onto the drum 40, when there is no load on the lifeline, but will allow lifeline to be drawn off by a steady pull.

The brake drum shown in FIGS. 8 and 9 is provided as a sealed unit. Correct and fault free operation of the brake is critical to the operation of the block, and thus the brake needs to be reconditioned from time to time. When the braking function needs to be reconditioned, the unit shown in FIGS. 8 and 9 can simply be removed and replaced with a new unit, to avoid having to service this part. As the correct functioning of the brake is critical to the operation of the block, it is highly desirable for this to be in the form of a sealed unit.

The central brake plate 80 is held fast to the hanger plate 18 through studs 29 which pass through the brake plate and the brake stud plate 84 (FIG. 9) so that these two plates rotate together.

The pawl ring 28 has an inwardly extending flange 86, and two friction rings or brake pads 88 sit between the flange 86 and the plates 80, 84. Thus, the pawl ring 28 can rotate relative to the (fixed) plates 80, 84 against the friction generated between the plates and the flange by the brake pads 88. The friction generated will depend on the clamping force by which the plates 80 and 84 are clamped together, and this force can be preset by tightening the nuts 85 on the studs 29. To seal the unit, O-ring seals 90 are provided between the outer edges of the plates 80, 84 and the pawl ring 28.

When the fall arrest block is serviced, and in any case after a fall has been arrested, the brake unit 24 will be replaced with a pre-assembled, pre-tested unit.

As a result of the skeletal nature of the drum 26, considerable weight savings can be made. The ability to attach different types of lifeline to a single drum configuration reduces stocking costs, and distributors of fall arrest blocks need only keep one type of block in stock, which can be would with whatever lifeline medium is requested by the end user.

The invention claimed is:

1. A fall arrest block for connection to a secure fixed point to protect a worker from a fall, comprising an external housing and inside said housing a rotatable drum and a lifeline, the drum comprising a core on which the lifeline is wound and a first flange and a second flange, said flanges being positioned on either side of the core, the core and the first flange being a plastics component, the lifeline having at one end thereof an anchoring end, said anchoring end being anchored to an anchorage point within the core, the lifeline in use being connected between the core of the drum and said worker, wherein the core has a plurality of said anchorage points, each of said anchorage points being at a separate location within the core and being of a different form from one another and wherein each of said different forms of anchorage points is suitable for anchoring a different type of lifeline anchoring end.

2. A fall arrest block as claimed in claim 1, wherein said anchorage points comprise an anchorage point for anchoring an anchoring end of a lifeline of wire rope and an anchorage point for anchoring an anchoring end of a lifeline of webbing.

3. A fall arrest block as claimed in claim 1, wherein the core is a skeletal plastics component, the core having a circumference around which the lifeline is wound, the outer periphery of the core at said circumference being discontinuous such that the lifeline is wound on annularly spaced regions of the periphery of the core around a pitch circle.

4. A fall arrest block as claimed in claim 1, wherein the core and the first flange are a unitary plastics component.

5. A fall arrest block as claimed in claim 4, wherein the second flange is in the form of a disc, and the core and the second flange have interengaging formations which prevent relative rotation between the second flange and the core.

6. A fall arrest block as claimed in claim 1, comprising additionally a spring for rewinding the lifeline onto the drum, and the core and the first flange are a unitary plastics component, wherein said component incorporates a housing for the spring on a side of the first flange, said side facing away from the core.

7. A fall arrest block as claimed in claim 1, wherein the core is a skeletal plastics component and the lifeline stretches between contact points around the outer periphery of the core, such that, in use with different types of lifeline having different types of anchoring end, the anchoring end of one type of lifeline is anchored at one end of said anchorage points between one pair of said contact points and the anchoring end of a different type of lifeline is anchored at another one of said anchorage points between a different pair of said contact points.

8. A brake unit for use in a fall arrest block having a rotatable drum, the brake unit comprising:

a first part, said first part comprising two spaced plates and being configured to be secured to a chassis of the fall arrest block;

a second part, said second part being in the form of a ring, wherein said ring has an outer periphery and an inner periphery, the outer periphery carrying outwardly directed teeth for locking said rotating drum when a fall is to be arrested such that, in use, said second part rotates relative to said first part, and wherein said ring has a flange that projects radially inwardly from said inner periphery, said inwardly projecting annular flange lying between the two spaced plates; and friction surfaces, the friction surfaces being located between said inwardly directed annular flange and the two spaced plates, whereby said relative rotation of said first part and said second part causes friction to be generated by the friction surfaces, thereby braking said relative rotation, and wherein the brake unit is a sealed unit so that said friction surfaces are sealed within the brake unit between the first part and second part of the brake unit.

9. A brake unit as claimed in claim 8, wherein said first part, said second part and the friction surfaces of the brake unit fit together to form a disc-shaped unit, and the two spaced plates each have a circular periphery and the ring of the second part of the brake unit comprises two annular portions, each of said annular portions lying generally around the circular periphery of one of said two spaced plates to form said disc.

10. A brake unit as claimed in claim 9, wherein said disc defines an axis and the first part comprises studs, the two spaced plates being connected together by said studs and said studs extending axially away from the two spaced plates so that said first part can be secured to the chassis.

11. A brake unit as claimed in claim 10, wherein said friction surfaces are located between each one of the two spaced plates and the inwardly directed annular flange, on both sides of said flange.

12. A brake unit as claimed in claim 11, wherein said friction surfaces are in the form of annuli.

13. A brake unit as claimed in claim 10, further comprising O-rings, said O-rings creating a seal between the circular periphery of the two spaced plates and said annular portions of the ring of the second part.

14. A brake unit as claimed in claim 13, wherein the disc of the brake unit has opposite sides and said annular portions of the ring are each an annular flange, said annular flanges extending in opposite directions on said opposite sides, and wherein said O-rings create said seal between the circular periphery of said two spaced plates and said annular flanges of the ring of the second part.

15. A brake unit as claimed in claim 8, wherein said first part has only two of said spaced plates.

16. A fall arrest block for connection to a secure fixed point to protect a worker from a fall, comprising a chassis, a brake unit, a rotatable drum and a lifeline, the lifeline being wound on the drum, wherein the brake unit comprises:

a first part, said first part comprising two spaced plates and being secured to the chassis;

a second part, said second part being in the form of a ring, wherein said ring has an outer periphery and an inner periphery, the outer periphery carrying outwardly directed teeth for locking said rotating drum when a fall is to be arrested such that, in use, said second part rotates relative to said first part, and wherein said ring has a flange that projects radially inwardly from said inner periphery, said inwardly projecting annular flange lying between the two spaced plates; and friction surfaces, the friction surfaces being located between said inwardly directed annular flange and the two spaced plates, whereby said relative rotation of said first part and said second part causes friction to be generated by the friction surfaces, thereby braking said relative rotation, and wherein the brake unit is a sealed unit so that said friction surfaces are sealed within the brake unit between the first part and second part of the brake unit.

17. A fall arrest block as claimed in claim 16, wherein the drum comprises a core on which the lifeline is wound and to which the lifeline is anchored, a first flange and a second flange, said flanges being positioned one on either side of the core, at least one pawl on a side of the second flange, said side facing away from the core, wherein said pawl and said teeth are configured such that when a fall is to be arrested said pawl engages with said teeth to lock said second part to said rotating drum.

18. A fall arrest block as claimed in claim 17, further comprising a spring for rewinding the lifeline onto the drum, the core and the first flange being a unitary plastics component, wherein said component incorporates a housing for the spring on a side of the first flange, said side facing away from the core.

19. A fall arrest block as claimed in claim 16, wherein said first part has only two of said spaced plates.

* * * * *